US005394127A

United States Patent [19]

Hendel

[11] Patent Number: 5,394,127

[45] Date of Patent: Feb. 28, 1995

[54] ELECTROMAGNETIC RELAY

[75] Inventor: Horst Hendel, Berlin, Germany

[73] Assignee: Siemens Aktiengesellschaft, Munich, Germany

[21] Appl. No.: 182,205

[22] PCT Filed: Jun. 23, 1992

[86] PCT No.: PCT/DE92/00519

§ 371 Date: Jan. 10, 1994

§ 102(e) Date: Jan. 10, 1994

[87] PCT Pub. No.: WO93/01608

PCT Pub. Date: Jan. 21, 1993

[30] Foreign Application Priority Data

Jul. 9, 1991 [DE] Germany ..... 4122704

[51] Int. Cl.[6] ..... H01H 51/22

[52] U.S. Cl. ..... 335/78; 335/80; 335/128

[58] Field of Search ..... 335/78-86, 335/131, 132, 133, 128

[56] References Cited

U.S. PATENT DOCUMENTS 3,152,237 10/1964 Richert .
3,165,607 1/1965 Hogan .
3,519,966 7/1970 Sprando et al. ..... 335/78
3,958,200 5/1976 Mally .
4,053,858 10/1977 Aidn et al ..... 335/276
4,554,521 11/1985 Hurter ..... 335/80

FOREIGN PATENT DOCUMENTS 1532608 7/1968 France .
1018959 11/1957 Germany .
1091193 4/1961 Germany .
1124153 2/1962 Germany .
2512574 9/1976 Germany .
3545356 6/1987 Germany .
758782 10/1956 United Kingdom .
765569 1/1957 United Kingdom .

*Primary Examiner*—Lincoln Donovan
*Attorney, Agent, or Firm*—Hill, Steadman & Simpson

[57] ABSTRACT

A relay having a basic body with a bearing pin secured in its wall or base which protrudes perpendicularly from the wall. A contact spring made of strip material is taken partly around the bearer pin with a securing section in the form or a clamping sleeve. Besides a spring shank it forms on the other side of the securing section a prestressing shank supported on a supporting component, preferably a coil flange and thus prestresses the spring shank in its position of rest. The contact spring can also be fitted in cramped and poorly accessible positions, e.g. between the coil and the armature and given a predetermined prestress without its having to be soldered to the bearer pin or subsequently adjusted.

7 Claims, 2 Drawing Sheets

ELECTROMAGNETIC RELAY

BACKGROUND OF THE INVENTION

1. Field of the Invention

The invention relates to an electromagnetic relay having a base body, at least one carrier pin which is anchored in a wall of the basic body and which emerges perpendicularly from the wall, and at least one contact spring which is of a strip shaped material, which is partly wrapped around the carrier pin and secured on it by means of a securing section, and which has a contacting spring shank which can be switched over by an armature about the axis of the terminal post between a resting position and a working position.

2. Description of the Related Art

Relays in which contact springs made from strip shaped material are secured in this way are well known, the terminal post generally being anchored in a base section or in another base body part. In relays of a conventional type, in which the contact springs are in each case partly wound around the terminal post by means of a securing end, as is disclosed, for example, in German Application 2,512,574, the contact spring must in any case additionally be secured on the terminal post by welding or in some other way, in order to prevent twisting of the contact spring during switching. This means that even after being fitted on the terminal post the securing end of the contact spring must be accessible for welding or for another type of securings if, however, the contact spring in a relay is arranged in a restricted space, for example between the armature and coil, the type of securing mentioned at the beginning is not possible. Furthermore, during welding of a strip spring on a pin a specific prestressing can be achieved only by special measures or by subsequent adjustment.

SUMMARY OF THE INVENTION

It is the object of the invention to provide contact springs and to secure the contact springs in a relay of the type mentioned at the beginning in such a way that the spring can easily be fitted on the pin even in the case of restricted conditions of space, and that the shaping of the spring itself is enough in conjunction with the overall structure of the relay to be able to achieve a desired prestressing which renders adjustment after fitting superfluous.

According to the invention, this and other objects is achieved when the base body is firmly joined to a coil former in front of one end face of which an armature of flat design is arranged, in that, furthermore, the carrier pin is arranged with the contact spring in the region between the armature and the coil former, in that the contact spring forms with its securing section a clamp sleeve which is plugged onto the carrier pin in a force-closed fashion, and has beyond the clamp sleeve a prestressing shank in the form of a continuation which is supported on the coil former and prestresses the spring shank into its rest position using via the carrier pin as a lever axis.

An arrangement of contact springs in the region between the armature and winding has already fundamentally been disclosed by German Application 3,545,356. There, however, the contact springs are anchored on the coil flange itself in plug-in slots; moreover, the contact springs there are constructed as bridge contacts without their own terminal components.

Furthermore, French Application 1,532,608 has also already disclosed a contact spring which is plugged onto a carrier pin with the aid of a clamp sleeve and is supported on a fixed contact with the aid of a second contact shank. However, it is a question there not of a relay but of a portable luminaire in which the contact spring is operated via different cam faces of a rotary button switch. Due to the shape and of the contact spring and the way in which it is secured, according to the invention, it is possible to set the desired prestressing for the contact shank via the angle between contact shank and prestressing shank in cooperation with the position of the supporting component of the coil former with respect to the carrier pin; the prestressing arises automatically as a result of the fitting of the preformed contact spring in the relay. The clamp sleeve also does not need to be additionally welded or otherwise secured on the carrier pin, since the supported prestressing shank in any case prevents twisting on the carrier pin. This is particularly advantageous in the arrangement according to the invention of the contact spring, because in the region between the armature and coil former there is generally little space for intervening with welding appliances or adjusting instruments. However, it is, of course, also possible in specific applications for the contact spring that is prestressed according to the invention to be subsequently secured in addition on its carrier pin by welding or in a similar way.

In a preferred embodiment, for the purpose of forming the two shanks the contact spring is bent approximately in the shape of a hairpin, the clamp sleeve being formed in the curved region between the two shanks.

The arrangement with a contact spring secured according to the invention can advantageously be used for a single-armature relay with a single magnet system or for a double-armature relay with a dual magnet system; in the case of the latter two coils are arranged on a common base body with two cores arranged in alignment with one another. In this case, it is possible, for example, to arrange in the region between the two coil formers two switch-over contacts which can be operated either by a common armature or by two armatures situated in parallel.

BRIEF DESCRIPTION OF THE DRAWINGS

The invention is explained in more detail below in terms of exemplary embodiments with the aid of the drawings which

DETAILED DESCRIPTION OF THE PREFERRED EMBODIMENTS

Figure 1:
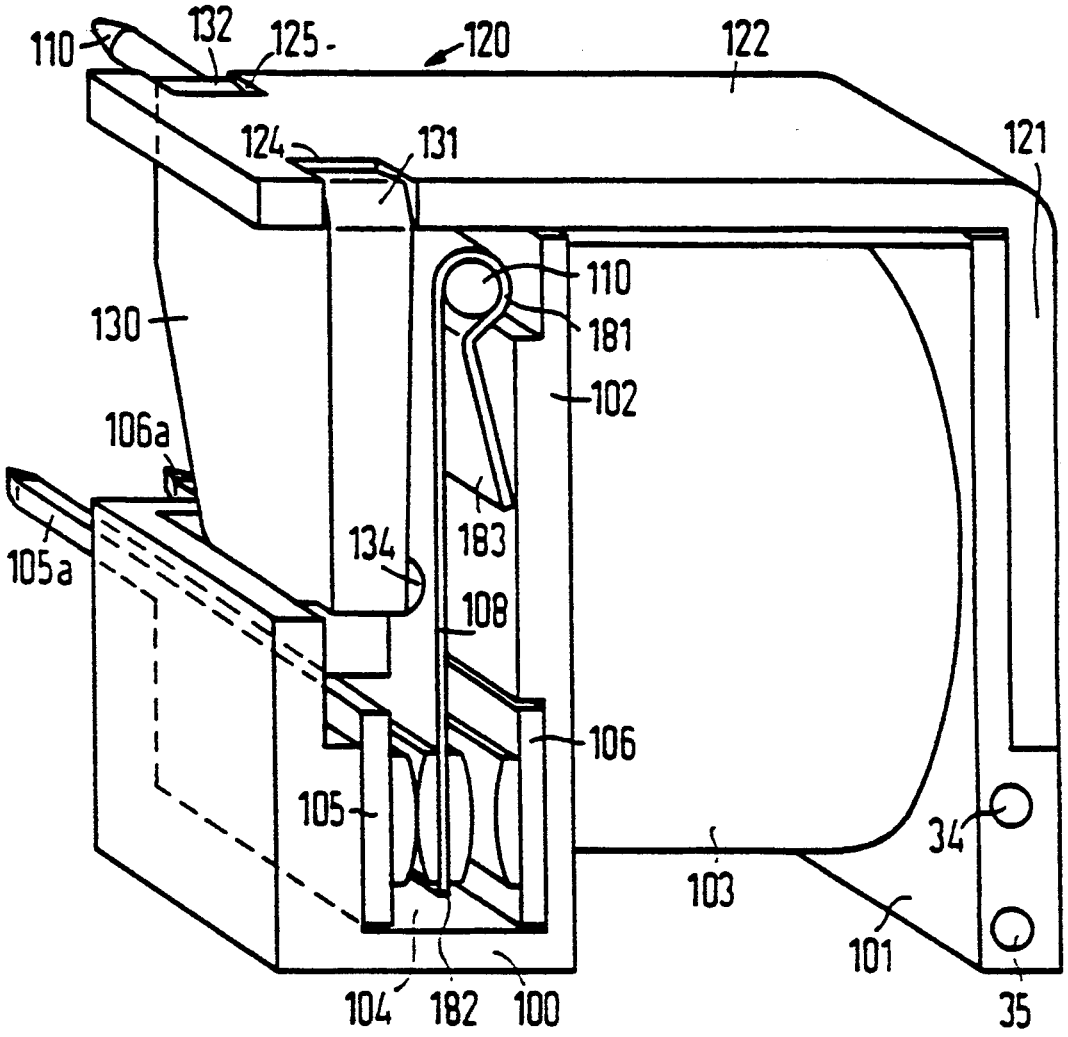
FIG. 1 shows a relay configured according to the invention and having a single magnet system and a switch-over contact, in a perspective view.

The relay in accordance with FIG. 1 has a base body 100 which forms a coil former having two flanges 101 and 102, between which a winding 103 is mounted. Winding terminals 34 and 35 are embedded in the coil flange 101. Integrally formed on the coil flange 102 is a contact chamber 104 into which two fixed mating contact elements 105 and 106 are plugged to be secured.

Corresponding terminal posts 105*a* and 106*a* emerge on the wiring post side. Furthermore, a yoke 120 having a shank 121 perpendicular to the coil axis and a shank 122 parallel to the coil axis is arranged on the coil former. The yoke shank 121 is coupled to a core (not visible), while the yoke shank 122 carries an armature 130 on its free end. The armature is mounted by means of retaining lugs 131 and 132 in bearing notches 124 and 125 of the yoke, as in shown in more detail in FIG. 3. These retaining lugs 131 and 132 are bent inwards during fitting into the corresponding bearing notches 124 and 125, respectively.

The armature 130 operates a contact spring 108 which can be switched over by means of its contact shank 182 between the two mating contact elements 105 and 106, and is secured by means of a securing section 181 in the form of a clamp sleeve on a carrier pin 110 which at the same time serves a terminal post. The contact spring 108 is bent approximately in the shape of a hairpin and has beyond the clamp sleeve 181 a prestressing shank 183 which is supported on the coil flange 102 and thus prestresses the spring shank 182 towards the armature 130 or towards the mating contact element 105. To operate the contact spring 108, the armature 130 has an operating cam 134, which is expediently of an insulating material to prevent the voltages at the contact spring from reaching the armature and the yoke. If this insulator is not necessary, the operating cam 134 can instead be integrally embossed directly on the armature.

Figure 2:
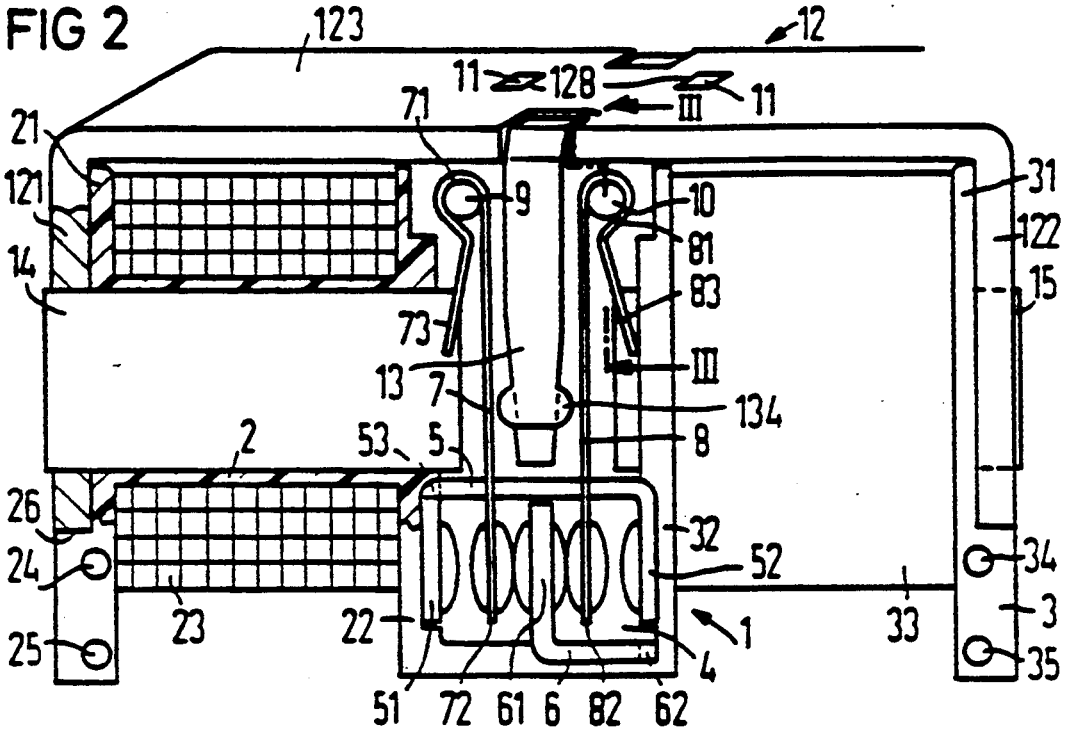
FIG. 2 shows a polarity reversal relay constructed according to the invention in a plan view, partially cut away and with a contour of a yoke indicated in a partially perspective fashion.

FIG. 2 shows another embodiment of a relay according to the invention which is in the form of a polarity reversal relay having two coils and a common armature 13. In this case, the relay has a base body 1 which has two coil formers 2 and 3 that are joined in one piece, and a contact chamber 4 formed between the two coil formers. A winding 23 is mounted on the coil former 2 between two flanges 21 and 22, and a winding 33 is mounted on the coil former 3 between flanges 31 and 32. Two terminal posts 24 and 25 for the winding 23 are embedded in the coil flange 21, and two terminal posts 34 and 35 for the winding 33 are embedded in the coil flange 31. The two windings can be driven and excited separately in this way. Since the two coil formers are integral parts of the base body 1, the two windings 23 and 33 can be produced in one operation on a winding machine.

Secured in the contact chamber 4 by being plugged in is a U-shaped contact plate 5 which is in one piece and yet forms two outer contact elements 51 and 52 and is guided by means of a terminal post 53 through the base of the base body. A further contact plate 6 forms a mid-position contact element 61 and a terminal post 62 guided through the base of the base body. The outer contact elements 51 and 52 are each provided with one contact piece, and the mid-position contact element 61 is provided with two contact pieces. Furthermore, two contact springs 7 and 8 which comprise leaf spring material are arranged in the contact chamber 4. Each contact spring is bent at a securing section to form a clamp sleeve 71 and 81, respectively, and is plugged by means of this clamp sleeve onto a terminal post 9 and 10, respectively. The contact springs each form contact shanks 72 and 82, respectively, which are provided in each case on both sides with contact pieces and can be switched over between the mid-position contact element 61 and in each case one mating contact element 51 and 52, respectively.

Furthermore, prestressing shanks 73 and 83, respectively, are also integrally formed on these contact springs 7 and 8 and are supported on the respective coil flange 22 or 32. Both contact springs 7 and 8 are prestressed towards the mid-position contact element 61 due to clamp sleeves 71 and 81, respectively, being forced closed and the prestressing of the shanks 73 and 83. Even when there is operating movement of the contact springs, there is no rotation on the terminal posts 9 and 10, respectively. However, the two shanks of the contact springs 7 and 8, respectively, which are each approximately in the shape of a hairpin are pressed together during operation, so that they are seated even more firmly on the respective terminal post 9 or 10. However, in some cases it could be necessary to secure the contact springs on the terminal posts by additional means, such as soldering or welding. This has no effect, however, on the prestressing, since this prestressing is already fixed during fitting by the insertion of the respective contact spring between the mid-position contact element 61 and the respective coil flange 22 and 32, respectively.

Figure 3:
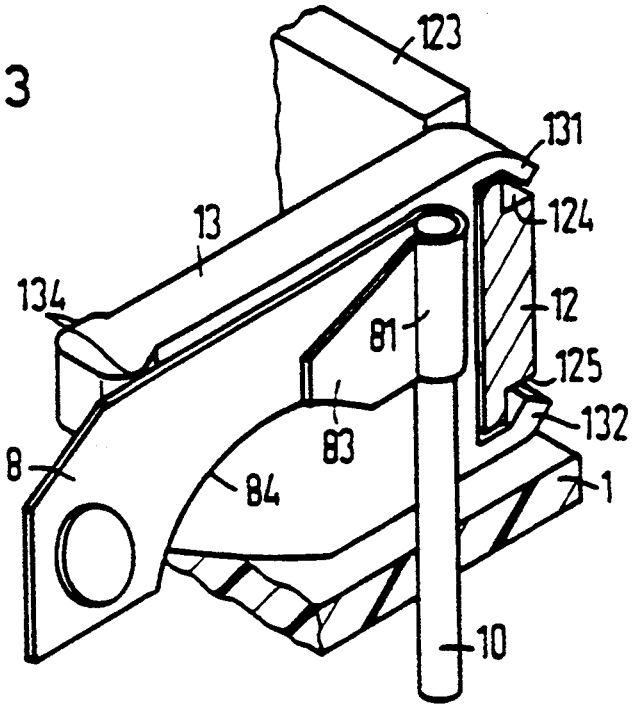
FIG. 3 shows a representation of a detail from FIG. 2 with the armature and a contact spring, in a perspective representation.

As may be seen from the representation of the detail shown in FIG. 3, the contact springs 7 and 8 each have (just like the contact spring 108 of FIG. 1) in their middle part a circular cutout, for example 84, which is adapted to the curvature of the associated-core and permits free movement of the contact spring above the core.

A yoke/armature subassembly is mounted on the coil former that is provided with windings and contact elements. A yoke 12 having two lateral sections 121 and 122 and an elongated middle section 123 is plugged onto the two outer coil flanges 21 and 31. Prior to this, an armature 13 which respectively has on its bearing end retaining lugs 131 and 132 as an extension of its lateral edges is mounted on the yoke 12. During fitting of the armature on the yoke middle section 123, these retaining lugs are bent into bearing notches 124 and 125, respectively, and in this way prevent the armature from falling out (see FIG. 3). The mobility of the armature in its bearing mounting is ensured by a pinpoint deflection of the armature to both sides over a range which is greater than the later operating movement.

After fitting of the armature, 13 in place the yoke 12 is plugged onto the base body 1, with the result that the lateral shanks 121 and 122 engage in corresponding cutouts of the flanges 21 and 31, respectively, and the armature projects into the contact chamber 4. Moreover, centering pins 11 which engage in openings 128 during fitting of the yoke are integrally formed on the base body 1 in order to increase the positional stability of the contact chamber. Thereafter, two cores 14 and 15 are pressed from the outside into axial recesses of the two coil formers and are joined to the yoke by an interference fit or in another way, for example punching or welding.

In addition, operating cams 134 which serve to operate the contact springs 7 and 8 are already integrally formed on both sides of the armature. In the present example, the thickness of the armature is selected to be so small between the two operating cams that the armature is situated decoupled with play between the two contact springs 7 and 8 when the latter both bear with their contact shanks 72 and 82 against the mid-position contact element 61. However, it would also be possible with a thicker armature and a corresponding spring prestressing to have only one contact spring bearing against the mid-position contact element in the resting state, and thus, for example, to provide a sequence-controlled contact.

The functioning of the relay follows directly from the structural configuration. In the resting state, the two contact springs 7 and 8 bear with their contact shanks 72 and 82 against the mid-position contact element 61. Depending on the excitation of a winding 23 or 33, the armature is pulled toward the associated core 14 or 15, bringing the associated contact springs 7 or 8 in contact with the corresponding outer contact element 51 or 52. The respective other contact spring in this case remains situated on the mid-position contact element 61. In the course of switching over from one coil to the other, the armature passes through a middle position in which the two contact springs 7 and 8 simultaneously make contact with the mid-position contact element 61, before the respective other contact spring is then connected to the associated outer contact element 52 or 51. If no windings are excited, the armature remains in the middle position, and the contact springs 7 and 8 are situated as a result of their prestressing on the mid-position contact element 61.

The embodiment of FIG. 2 could also be modified such that each of the contact springs 7 and 8 cooperates with a dedicated pair of mating contact elements, for example similar to the mating contact elements 105 and 106 of FIG. 1. Instead of the armature 13, it would also be possible to insert two parallel armatures into the yoke middle part between the two contact springs 7 and 8. In this case, one armature would respectively switch an associated contact spring 7 and 8, respectively, independently of the other. In this case, it would then be necessary to provide, at least between one of the armatures and the associated contact spring, an insulating operating member, for example an insulating operating cam, in order to isolate the two systems electrically.

The embodiment according to FIG. 1 and 2 are selected such that the main planes of the yoke are perpendicular to the terminal plane and the yoke surrounds the relay laterally on three sides. It would also be conceivable to rotate the relay with its fitting plane by 90° around the core axis, so that the yoke would come to be situated with its middle section with respect to the fitting plane above the coils and the contact chamber. The terminal posts 24, 25 and 34, 35, respectively, and 9, 10, 53, 62 and 105*a*, 106*a*, respectively, are then led out not to the rear but downwards in the representation of FIG. 1 and FIG. 2, respectively. Modifications having in each case more than one contact spring on in each case one terminal post are also conceivable.

Although other modifications and changes may be suggested by those skilled in the art, it is the intention of the inventor to embody within the patent warranted hereon all changes and modifications as reasonably and properly come within the scope of his contribution to the art.

I claim:

1. An electromagnetic relay, comprising:

a base body having a wall, an armature;

a terminal pin having an axis;

at least one carrier pin anchored in said wall of said base body and extending perpendicularly from said wall, and at least one contact spring which comprises a strip material, which is partly wrapped around said at least one carrier pin and secured on said at least one carrier pin by a securing section, and has a contacting spring shank which can be switched over by said armature about the axis of said terminal post between a position of rest and a working position, a coil former to which said base body is firmly joined in front of one end face of which said armature of flat design is arranged, said carrier pin being arranged with said at least one contact spring between said armature and said coil former, said securing section of said at least one contact spring being a clamp sleeve which is plugged onto said at least one carrier pin in a force-closed fashion, and a prestressing shank extending beyond said clamp sleeve as a continuation which is supported on said coil former and prestresses said spring shank into said position of rest via said at least one carrier pin as a lever axis.

2. A relay as claimed in claim 1, wherein said at least one contact spring is bent approximately in a shape of a hairpin having two shanks, said clamp sleeve being formed in a curved region between said two shanks.

3. A relay as claimed in claim 1, wherein said at least one carrier pin serves as an electrical terminal post for said at least one contact spring.

4. A relay as claimed in claim 1, wherein said coil former is a first coil former having a core and a winding, said at least one contact spring is a first contact spring, and said armature is a first armature, and further comprising:

a second coil former with a winding and a core in substantially axial alignment with respect to said first coil former and joined to said base body, a yoke of a U shape connecting two outer core ends of said core of said first coil former and said second coil former, a second armature mounted parallel to said first armature generally on a middle section of said yoke between two inner core ends which face one another of said core of said first coil former and said core of said second coil former, and a second contact spring arranged between said second armature and said second coil former, said second contact spring being operated by said second armature.

5. A relay as claimed in claim 1, wherein said coil former is a first coil former having a core and a winding and said at least one contact spring is a first contact spring, and further comprising:

a second coil former with a winding and a core in substantially axial alignment with respect to said first coil former and joined to said base body, a U-shaped yoke connecting two outer core ends of said core of said first coil former and said core of said second coil former, said armature being mounted on a middle section of said U shaped yoke between two inner core ends which face one another of said core of said first coil former and said core of said second coil former, and a second contact spring is arranged between said armature and said second coil former formers and operable by said armature.

6. A relay as claimed in claim 1, wherein said coil former is integrally formed on said base body.

7. A relay as claimed in claim 1, wherein said at least one carrier pin is embedded in said base body.

* * * * *